US007670462B2

(12) United States Patent
Gibson et al.

(10) Patent No.: US 7,670,462 B2
(45) Date of Patent: Mar. 2, 2010

(54) SYSTEM AND METHOD FOR ON-LINE CLEANING OF BLACK OIL HEATER TUBES AND DELAYED COKER HEATER TUBES

(75) Inventors: William C. Gibson, Tulsa, OK (US); Robert L. Gibson, Broken Arrow, OK (US)

(73) Assignee: Great Southern Independent L.L.C., Broken Arrow, OK (US)

( * ) Notice: Subject to any disclaimer, the term of this patent is extended or adjusted under 35 U.S.C. 154(b) by 993 days.

(21) Appl. No.: 11/403,298

(22) Filed: Apr. 13, 2006

(65) Prior Publication Data

US 2007/0240739 A1 Oct. 18, 2007

(51) Int. Cl.

| | |
|---|---|
| ***C10B 47/00*** | (2006.01) |
| ***B08B 9/04*** | (2006.01) |
| ***F22B 37/18*** | (2006.01) |

(52) U.S. Cl. ..... 201/2; 202/241; 134/8; 134/19; 134/22.12; 134/103.2; 134/166 R; 134/168 R; 134/168 C; 122/379; 122/404

(58) Field of Classification Search ..... 201/2; 134/8, 19, 22.11, 22.12, 23, 24, 103.2, 103.3, 134/106, 166 R, 167 R, 168 R, 168 C, 167 C; 122/379, 404; 202/241

See application file for complete search history.

(56) References Cited

U.S. PATENT DOCUMENTS

| | | | |
|---|---|---|---|
| 6,241,855 | B1 | 6/2001 | Gibson et al. |
| 6,245,218 | B1 | 6/2001 | Gibson et al. |
| 6,264,798 | B1 | 7/2001 | Gibson et al. |

*Primary Examiner*—N. Bhat
(74) *Attorney, Agent, or Firm*—Gable Gotwals

(57) ABSTRACT

A system and method whereby on-line cleaning of black oil heater tubes and delayed coker heater tubes may be effectuated by injecting a high pressure water charge through the tubes during normal process operations so as to prevent tube fouling and heater downtime. The high pressure water charge begins the on-line cleaning process once it enters the heater tube by undergoing intense boiling and evaporation. The cleaning occurs by two methods—a scrubbing action and a shocking action. The scrubbing action occurs because of the complete turbulence caused by the water charge's intense boiling within the heater tubes. The shocking action is caused by the expansion and contraction of the heater tubes resulting from the colder water charge flowing through the heater tubes which is then followed by the hotter process fluid flowing through the heater tubes.

55 Claims, 2 Drawing Sheets

SYSTEM AND METHOD FOR ON-LINE CLEANING OF BLACK OIL HEATER TUBES AND DELAYED COKER HEATER TUBES

CROSS-REFERENCE TO RELATED APPLICATIONS

Not applicable.

STATEMENT OF FEDERALLY SPONSORED RESEARCH/DEVELOPMENT

Not applicable.

THE NAMES OF THE PARTIES TO A JOINT RESEARCH AGREEMENT

Not applicable.

REFERENCE TO A SEQUENCE LISTING

Not applicable.

BACKGROUND OF THE INVENTION

The present invention relates generally to black oil heaters and delayed coker heaters used in crude oil refining. More specifically, the present invention discloses a system and method whereby on-line cleaning of black oil heater tubes and delayed coker heater tubes may be effectuated by injecting a high pressure water charge through the tubes during normal process operation so as to prevent tube fouling and heater downtime. The present invention can be used for a variety of applications including, but not limited to, cleaning the tubes of crude heaters, vacuum heaters, visc breaker heaters, delayed coker heaters and any other heaters that have downstream equipment capable of handling the amount of water/steam injected into the heaters.

The present invention can be best understood and appreciated by undertaking a brief review of the crude oil distillation process, and most particularly, the role delayed coking plays within that process.

In its unrefined state, crude oil is of little use. In essence, crude oil is a complex chemical compound consisting of numerous elements and impurities. Such impurities can include, but are not limited to sulfur, oxygen, nitrogen and various metals that must be removed during the refining process.

Refining is the separation and reformation of a complex chemical compound into desired hydrocarbon products. Such product separation is possible as each of the various hydrocarbons comprising crude oil possess an individual boiling point. During refining, or distillation, crude oil feedstock temperature is raised to a point where boiling begins (the "initial boiling point," or the "IBP") and continues as the temperature is increased. As the boiling temperature increases, the butane and lighter fraction of crude oil are first distilled. Such distillation begins at the IBP and terminates slightly below 100° F.

The next fraction, or cut, begins slightly under 100° F. and terminates at approximately 220° F. This fraction is represented and referred to as straight run gasoline. Then, beginning at 220° F. and continuing to about 320° F. the Naphtha cut occurs, and is followed by the kerosene and gas/oil cuts, occurring between 320° F. and 400° F., and 450° F. to 800° F., respectively. A term-of-art "residue cut" includes everything boiling above 800° F.

The residue cut possesses comparatively large volumes of heavy liquid hydrocarbons which undergo delayed coking operations to produce various more valuable hydrocarbon fractions and coke. Any suitable delayed coking feedstock can be used as starting material, including vacuum tower bottoms from a crude oil refining process.

Delayed coking is generally carried out by initially heating a liquid feedstock in a coker heater to a coking temperature, often between 875° F. and 950° F. The coker heater includes a coil of multiple coker heater tubes wherein the feedstock is heated before passing to a coker drum. During the coker heater operation, there exists temperature and pressure gradients along the coker heater tubes. Thermal cracking of the heated feedstock occurs primarily in the coking drum to yield mixed volatile hydrocarbon vapors and coke. The vapors are drawn off overhead and introduced to a combination tower wherein hydrocarbon fractions including gases, distillate streams and a heavy gas oil stream are separated and subsequently isolated.

Although thermal cracking of the heated feedstock occurs primarily in the coking drum, there is some premature coking occurring in the radiant coker heater tubes which causes tube fouling. Fouling of the internal walls of the coker heater tubes can cause blockages requiring periodic operation shut-downs to clean the tubes. Modern delayed coking operations present the potential for rapid tube fouling due to increased feed rates and increased concentrations of fouling components in feedstocks such as asphaltenes, inorganics and heavy metals. Usually, it is the capacity of the delayed coker heater which limits the refinery capacity. Therefore, anything that can increase the capacity of the delayed coker heater will result in increased production throughout the refinery. Typically, there is a 3/1 or greater factor capacity increase in crude charge rate to the refinery which corresponds to the increase in delayed coker heater capacity.

The methods that have been used to clean the coker heater tubes' internal walls are on-line spalling, pigging and steam-air decoking. In on-line spalling, the coke is removed from the coker heater tube by varying the steam or condensate flow rate on the fouled tube such that a thermal shock is created that breaks the coke from the tube. The spalling medium transfers the coke particles into the coker heater effluent where it is then collected in the downstream coker drum. An advantage to on-line spalling is that the coker heater is allowed to remain in normal hydrocarbon service because commonly only one pass is spalled at a time while the other passes continue normal operation. However, the cleaning effectiveness of on-line spalling decreases each time it is performed.

For example, a clean coker heater would operate with maximum tube metal temperatures at about 1020° F. and would be allowed to operate until the operating temperature reaches about 1200° F., which would occur in approximately 4 to 6 weeks. Once the operating temperature reaches about 1200° F., on-line spalling is performed which results in the operating temperature being about 1040° F. The coker heater would be allowed to operate until the operating temperature again reaches about 1200° F., which would occur in approximately 3 to 5 weeks. On-line spalling would be performed again which results in the operating temperature being about 1060° F. The coker heater would be allowed to operate until the operating temperature again reaches about 1200° F., which would occur in approximately 2 to 4 weeks. At this time, the entire heater would have to be taken down for a complete cleaning, either by pigging or by steam-air decoking. Thus, on-line spalling only delays, but does not eliminate, the complete cleaning of the coker heater.

In pigging, the coke is removed from the coker heater tube by pushing with water a metal studded foam or plastic "pig" through the heater coil. The metal studded "pig" rotates such that it scrapes the coke off the inside of the coker heater tube. Different sizes and abrasiveness "pigs" are used during this process. The "pigs" are usually pumped through the coker heater several times forward and backward until the overall differential pressure across the tube is restored to its original unfouled condition. An advantage to the "pigging" process is that a significant percentage of the coke is removed from inside the tubes. However, a disadvantage of this process is that the coker heater is required to be taken fully out of service anywhere from 1 to 3 days per heater.

In steam-air decoking, the coke is burned off the coker heater tubes by firing the coker heater in a controlled decoking process by circulating a steam-air mixture at elevated temperatures. The air is used to burn the coke off the tubes, while the steam is used to keep the burning temperatures low such that they do not exceed the maximum allowable tube metal temperatures. An advantage to the steam-air decoking process is that almost all the coke is removed from inside the tubes. However, a disadvantage of this process is that the coker heater is required to be taken fully out of service and heater tubes can be damaged if overheated.

What has been lacking, however, until the present invention, and what the industry long has sought, is an on-line cleaning system and method for black oil heater tubes and delayed coker tubes whereby tube fouling is significantly reduced and/or completely eliminated, thereby allowing the black oil heaters and the delayed coker heaters to remain on-line. The present invention cleans the heater tubes by injecting a high pressure water charge through the tubes during operation so as to prevent tube fouling and heater downtime. The water charge is at a lower temperature than the temperature of the heater tubes. Cleaning occurs by two methods, a scrubbing action caused by the water charge boiling and a shocking action caused by heater tube expanding and contracting due to the temperature differential between the water charge and the heater tube.

It is, therefore, an object of the present invention to disclose and claim an on-line cleaning system and method for black oil heater tubes and for delayed coker heater tubes by injecting a water charge during normal operation.

It is a further object of the instant invention to disclose and claim an on-line cleaning system and method for black oil heater tubes and for delayed coker heater tubes that significantly reduces and/or entirely eliminates tube fouling.

It is still a further object of the present invention to disclose and claim an on-line cleaning system and method for black oil heater tubes and for delayed coker heater tubes that is automated.

It is yet another object of the present invention to disclose and claim an on-line cleaning system and method for black oil heater tubes and for delayed coker heater tubes that cleans by a scrubbing action, caused by the boiling of water, and a shocking action, caused by the temperature difference between the water charge and the heater tube.

It will become apparent to one skilled in the art that the claimed subject matter as a whole, including the structure of the system, and the cooperation of the elements of the system, combine to result in the unexpected advantages and utilities of the present invention. The advantages and objects of the present invention and features of such an on-line cleaning system and a method for black oil heaters and delayed coker heaters will become apparent to those skilled in the art when read in conjunction with the accompanying description, drawing figures, and appended claims.

BRIEF SUMMARY OF THE INVENTION

A method for on-line cleaning and preventing tube fouling within a black oil heater comprising the steps of a) providing a black oil heater having a plurality of tubes; b) providing a connector on the plurality of tubes; c) providing a water charge line having a first end and a second end, wherein the second end is connected to the connector; d) determining an amount of high pressure water to be injected into the plurality of tubes; e) introducing the amount of high pressure water into the plurality of tubes via the water charge line while the black oil heater is continuously operating; and f) cleaning the plurality of tubes by allowing the amount of high pressure water to boil throughout the plurality of tubes.

A method for on-line cleaning and preventing tube fouling within a black oil heater comprising the steps of a) determining a predetermined amount of high pressure water to be injected into a plurality of tubes located within a black oil heater during the on-line cleaning mode; b) determining a long-cycle, having a first rate, and a short-cycle, having a second rate, for the on-line cleaning mode; c) providing a connector on the plurality of tubes; d) providing a steam line for providing steam to the connector during normal operations, wherein the steam line comprises a flow measuring device and a control valve located upstream to a first steam line tee and at least one steam line check valve located between the first steam line tee and a second steam line tee; e) providing a container designed to hold the predetermined amount of high pressure water; f) providing a water charge steam line connecting the first steam line tee to the container, wherein the water charge steam line comprises at least one water charge steam line check valve and a flow restricting device; g) providing a water charge line connecting the container to the second steam line tee, wherein the water charge line comprises a high pressure water tee and a first on/off valve, wherein the first on/off valve is in the open position during normal operations; h) providing a high pressure water line connecting a high pressure water supply header to the high pressure water tee, wherein the high pressure water line comprises a second on/off valve and at least one high pressure water check valve, wherein the second on/off valve is in a closed position during normal operations; i) allowing steam to flow to the plurality of tubes during normal operations; j) initiating the long-cycle of the on-line cleaning mode; k) filling the container with high pressure water by closing the first on/off valve and opening the second on/off valve; l) allowing the pressure in the container to reach an equilibrium pressure; m) transferring the high pressure water in the container to the plurality of tubes by opening the first on/off valve and closing the second on/off valve; n) cleaning the plurality of tubes by allowing the predetermined amount of high pressure water to boil throughout the plurality of tubes; o) allowing the pressure in the container to return back to the normal operating pressure; p) repeating the short-cycles by cycling the first on/off valve and the second on/off valve until the short-cycles are completed; and q) returning to normal operating mode until the long-cycle initiates again.

An on-line cleaning system for preventing tube fouling within a black oil heater comprising a) a steam line connecting a steam supply header to a plurality of tubes located within the black oil heater via a connector, wherein the steam line comprises a flow measuring device and a control valve located upstream to a first steam line tee and at least one steam line check valve located between the first steam line tee and a second steam line tee; b) a container designed to hold an amount of high pressure water to be supplied to the plurality of tubes during on-line cleaning; c) a water charge steam line connecting the first steam line tee to the container, wherein the water charge steam line comprises at least one water charge steam line check valve and a flow restricting device; d) a water charge line connecting the container to the second steam line tee, wherein the water charge line comprises a high pressure water tee and a first on/off valve; and e) a high pressure water line connecting a high pressure water supply header to the high pressure water tee, wherein the high pressure water line comprises a second on/off valve and at least one high pressure water check valve.

The foregoing has outlined broadly the more important features of the invention to better understand the detailed description that follows, and to better understand the contribution of the present invention to the art. As to those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart for the spirit and scope of the present invention. Further, the abstract associated with this disclosure is neither intended to define the invention, which is measured by the claims, nor intended to be limiting as to the scope of the invention in any way.

These together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be made to the accompanying drawings and descriptive matter in which there are illustrated preferred embodiments of the invention.

It should be understood that any one of the features of the invention may be used separately or in combination with other features. It should be understood that features which have not been mentioned herein may be used in combination with one or more of the features mentioned herein. Other systems, methods, features, and advantages of the present invention will be or become apparent to one with skill in the art upon examination of the drawings and detailed description. It is intended that all such additional systems, methods, features, and advantages be protected by the accompanying claims.

These and other objects, features and advantages of the present invention will be more readily apparent when considered in connection with the following, detailed description of preferred embodiments of the invention, which description is presented in conjunction with annexed drawings below.

BRIEF DESCRIPTION OF THE DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawings, in which.

DETAILED DESCRIPTION OF THE INVENTION

Figure 1:
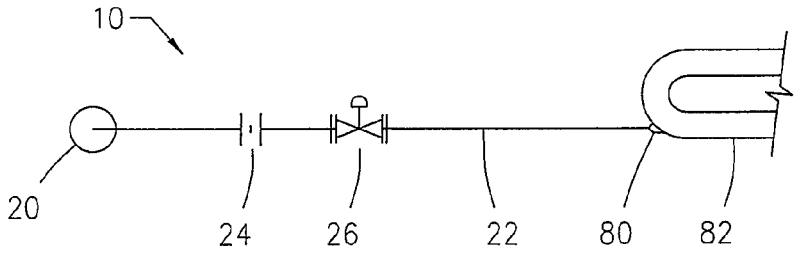
FIG. 1 depicts a steam supply system providing continuous velocity steam injection to the tubes for black oil heaters and delayed coker heaters of the prior art.

The following discussion is presented to enable a person skilled in the art to make and use the invention. The general principles described herein may be applied to embodiments and applications other than those detailed below without departing from the spirit and scope of the present invention as defined by the appended claims. The present invention is not intended to be limited to the embodiments shown, but is to be accorded the widest scope consistent with the principles and features disclosed herein.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative of but a few of the various ways in which the principles of the invention may be employed. Other objects, advantages, and novel features of the invention will become apparent from the following detailed description of the invention when considered in conjunction with the drawings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Prior art FIG. 1 illustrates a steam supply system providing continuous velocity steam injection to a tube for black oil heaters and delayed coker heaters of the prior art. The system of the prior art is generally indicated as 10. The prior art's steam supply system 10 comprises a steam supply header 20, a steam line 22, a steam line orifice plate 24, a steam line control valve 26, a steam line connector 80 and a process heater tube 82. The steam line 22 connects the steam supply header 20 to the process heater tube 82 via the steam line connector 80. The steam line orifice plate 24 is located on the steam line 22 with the steam line control valve 26 located downstream of the steam line orifice plate 24. Although FIG. 1 depicts the steam supply system 10 adding continuous velocity steam injection to the process heater tube 82, one skilled in the art would be aware that this steam supply system 10 may also add velocity steam injection to a section located between the convection section (not shown) and the radiant section (not shown) of a black oil heater or a delayed coker heater without departing from the scope and spirit of the present invention.

As practiced in the prior art, which is illustrated in FIG. 1, the steam line 22 provides a minimum 100 lbs/hr continuous velocity steam injection from the steam supply header 20 to the process heater tube 82. The steam in the steam supply header 20 is about 450 psig, preferably within the range of approximately 250 psig to about 450 psig, and may be at saturation to about 50° F. superheat. The steam line orifice plate 24 is used to measure the velocity steam injection flow rate and the steam line control valve 26 is used to provide the necessary pressure drop required in the steam line 22 so that the proper velocity steam injection flow rate can be maintained. If the velocity steam injection is added to the process heater tube 82, as shown in FIG. 1, the velocity steam injection flow rate is minimally about 100 lbs/hour. If the velocity steam injection flow rate, however, is added in the section between the convection section (not shown) and the radiant section (not shown), the velocity steam injection flow rate is minimally about 500 lbs/hour to 1000 lbs/hour. These minimum velocity steam injection flow rates are continuously added into the process system to ensure that there is no blockage being formed at the steam line connector 80.

Figure 2:
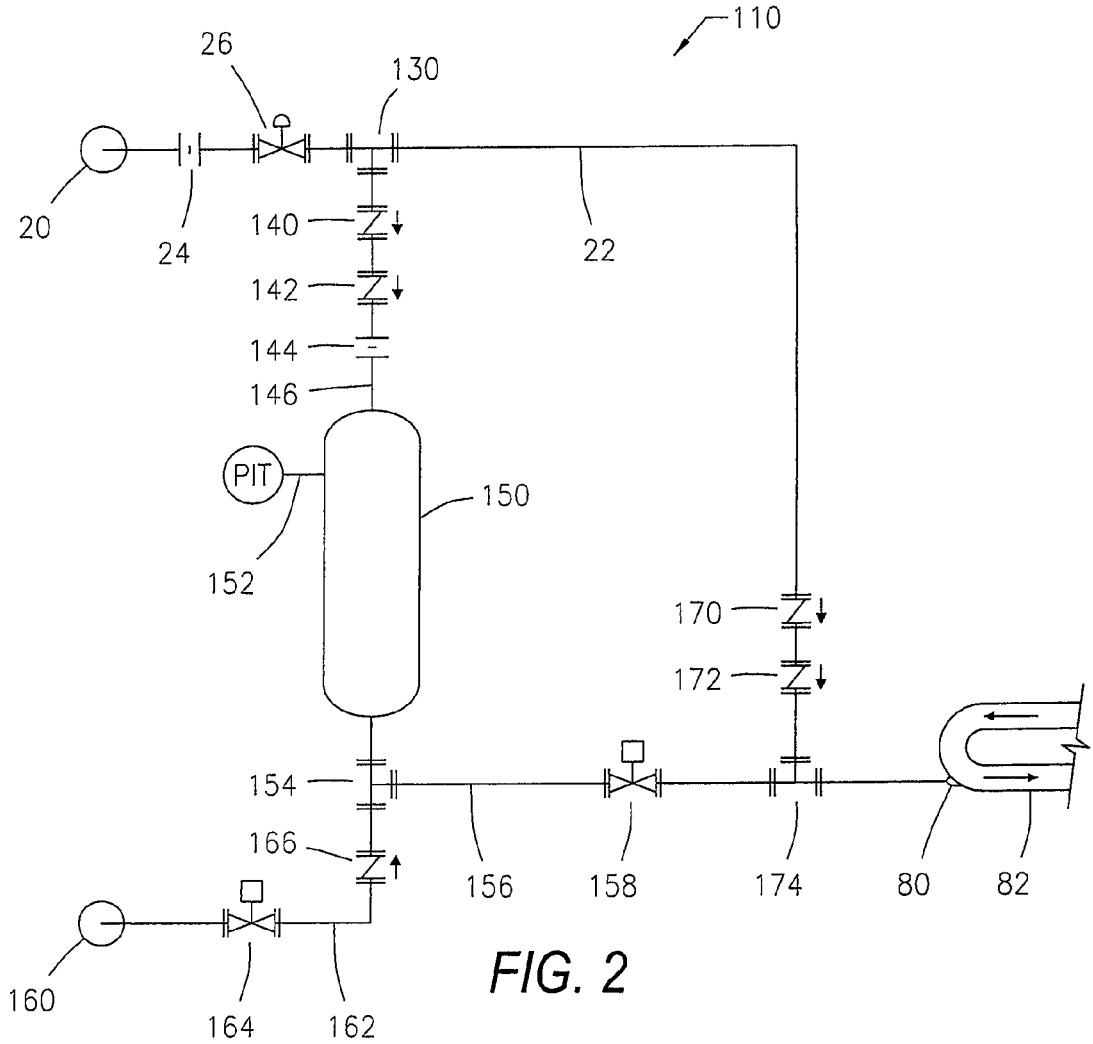
FIG. 2 depicts an on-line cleaning system for black oil heaters and delayed coker heaters according to one embodiment of the present invention.

FIG. 2 illustrates an on-line cleaning system for black oil heaters and delayed coker heaters according to one embodiment of the present invention. The system of the present invention is generally indicated as 110. In the preferred embodiment, the on-line cleaning system 110 comprises a water charge tank 150 that is used for accumulating high pressure boiler feed water and discharging it into the process heater tube 82 for on-line tube cleaning. Although the preferred embodiment utilizes high pressure boiler feed water, one skilled in the art will understand that any high pressure water may be used, so long as the downstream equipment can handle it and that it does not cause tube fouling, without departing from the scope and spirit of the present invention.

According to the preferred embodiment as shown in FIG. 2, a first steam line tee 130 is installed on the steam line 22 at a location downstream to the steam line control valve 26. A water charge steam line 146 is installed from the first steam line tee 130 going to the water charge tank 150. The water charge steam line 146 comprises a first water charge steam line check valve 140, a second water charge steam line check valve 142 and a water charge steam line orifice plate 144, which is located downstream of the two water charge steam line check valves 140, 142. Two water charge steam line check valves 140, 142 are used to ensure that high pressure boiler feed water does not enter into the steam line 22. It will be understood by one skilled in the art, however, that although the preferred embodiment depicts two water charge steam line check valves 140, 142 located on the water charge steam line 146, these water charge steam line check valves 140, 142 are not limited in number and can be one or more than two, depending on the refinery plant design requirements, without departing from the scope and spirit of the present invention. Also, although the water charge steam line orifice plate 144 is shown as a flow restricting device on the water charge steam line 146, one skilled in the art will understand that any flow restricting device may be used alternatively to the water charge steam line orifice plate 144 without departing from the scope and spirit of the present invention.

FIG. 2 shows the water charge tank 150 being installed downstream of the water charge steam line 146. In the preferred embodiment, the water charge tank 150 is about a 10 inch diameter cylinder with an approximate height of 20 inches, which is designed to hold 2.65 gallons of high pressure boiler feed water. It is preferred that the height to width ratio is 2:1 for space and economic reasons. It will be understood by one skilled in the art, however, that although the preferred embodiment depicts the water charge tank 150 with certain dimensions with a preferred height to width ratio, these dimensions and ratios may vary, depending on the amount of water charge calculated as being required for the on-line cleaning of a specific heater and depending on the installation room available, without departing from the scope and spirit of the present invention. The top and bottom of the water charge tank 150 is depicted as being semi-spherical. One skilled in the art, however, will understand that the top and bottom of the water charge tank 150 can be made of any geometric shape without departing from the scope and spirit of the present invention. The water charge tank 150 can be made of carbon steel, 1¼ chrome, 2¼ chrome, 5 chrome, 9 chrome, 347H stainless steel or any other suitable material capable of handling the pressures and temperatures of the high pressure boiler feed water and the velocity steam injection, but is preferably made of 9 chrome or 347H stainless steel. FIG. 2 also shows a pressure indicator transmitter 152 located near the top of the water charge tank 150. This pressure indicator transmitter 152 measures the pressure within the water charge tank 150 and continuously relays that information to a control panel (not shown), which controls the opening and closing of valves and is located either locally or remotely.

FIG. 2 additionally shows a second steam line tee 174 installed on the steam line 22 at a location downstream to the first steam line tee 130 and upstream of the steam line connector 80. There is also a first steam line check valve 170 and a second steam line check valve 172 installed on the steam line 22, and is located downstream to the first steam line tee 130 and upstream of the second steam line tee 174. Two steam line check valves 170, 172 are used to ensure that high pressure boiler feed water does not enter into the steam line 22. It will be understood by one skilled in the art, however, that although the preferred embodiment depicts two steam line check valves 170, 172 located on the steam line 22, these steam line check valves 170, 172 are not limited in number and can be one or more than two, depending on the refinery plant design requirements, without departing from the scope and spirit of the present invention.

Also illustrated in FIG. 2, a water charge line 156 is installed from the water charge tank 150 going to the second steam tee line 174. The water charge line 156 comprises a boiler feed water tee 154 and a water charge solenoid valve 158, which is located downstream to the boiler feed water tee 154. The water charge solenoid valve 158 is controlled by the control panel (not shown), which continuously receives pressure information from the pressure indicator transmitter 152. Also, although the water charge solenoid valve 158 is shown as an automatically controlled on/off valve, one skilled in the art will understand that any on/off valve or device, even if not automatically controlled, may be used alternatively to the water charge solenoid valve 158 without departing from the scope and spirit of the present invention.

Also shown with reference to FIG. 2, a boiler feed water line 162 is installed from a boiler feed water supply header 160 to the boiler feed water tee 154. The boiler feed water supply header 160 is normally operating at high pressures at about 600 psig, preferably within the range of approximately 400 psig to about 600 psig, and approximately at 225° F. One skilled in the art will understand that these operating pressures and temperature may be higher or lower depending on what is available at the refinery plant without departing from the scope and spirit of the present invention; however, if the operating pressure is close to or less than the operating pressure of the velocity steam in the steam supply header 20 then a booster pump (not shown) will need to be installed on the boiler feed water line 162 so that the boiler feed water pressure can be increased for filling the water charge tank 150. The boiler feed water line 162 comprises a boiler feed water solenoid valve 164 and a boiler feed water check valve 166, which is located downstream to the boiler feed water solenoid valve 164. The boiler feed water solenoid valve 164 is controlled by the control panel (not shown), which continuously receives pressure information from the pressure indicator transmitter 152. One boiler feed water check valve 166 is used to ensure that oil does not enter into the boiler feed water line 162. Also, although the boiler feed water solenoid valve 164 is shown as an automatically controlled on/off valve, one skilled in the art will understand that any on/off valve or device, even if not automatically controlled, may be used alternatively to the boiler feed water solenoid valve 164 without departing from the scope and spirit of the present invention. It will also be understood by one skilled in the art, however, that although the preferred embodiment depicts one boiler feed water check valve 166 located on the boiler feed water line 162, the boiler feed water check valve 166 is not limited in number and can be more than one, depending on the refinery plant design requirements, without departing from the scope and spirit of the present invention.

In the preferred embodiment, the steam line 22, the water charge line 156 and the boiler feed water line 162 are all approximately 3" diameter piping. The steam line connector 80 is approximately 1½" diameter. The process heater tube is about 4½" diameter tubing. It will be understood by one skilled in the art, however, that although the preferred embodiment depicts the piping, connector and tubing as being 3", 1½" and 4½", respectively, these sizes may vary depending on the system requirements without departing from the scope and spirit of the present invention. The preferred embodiment shows the on-line cleaning system 110 to be connected to the process heater tube 82. It will be understood by one skilled in the art, however, that although the preferred embodiment depicts the on-line cleaning system 110 to be connect to the process heater tube 82 at one location, the on-line cleaning system 110 may be connected at multiple locations along the process heater tube 82 and/or at multiple locations along the section between the convection section (not shown) and the radiant section (not shown), without departing from the scope and spirit of the present invention.

As practiced in the preferred embodiment and illustrated in FIG. 2, the water charge solenoid valve 158 is in the open position, while the boiler feed water solenoid valve 164 is in the close position during normal operations. During normal operations, the velocity steam travels from the steam supply header 20, which is operating at about 450 psig, preferably in the range of about 250 psig to about 450 psig, and at about 50° F. superheat, and flows to the process heater tube 82. The velocity steam travels through the steam line orifice plate 24, which measures velocity steam flow rate, and then through the steam line control valve 26, which adjusts accordingly to ensure proper velocity steam flow rate. Generally, the velocity steam flow rate is minimally about 100 lbs/hour when it flows into the process heater tube 82 and about 500 to 1000 lbs/hour when it flows into a section between the convection section (not shown) and the radiant section (not shown). The minimum velocity steam flow rates are continuously flowing during normal operations so that blockage does not occur at the steam line connector 80. The majority of the velocity steam continues to flow along the steam line 22 directly to the process heater tube 82. However, a small amount of the velocity steam flow rate is diverted from the steam line 22 at the first steam line tee 130 and eventually flows back into the steam line 22 at the second steam line tee 174, via the water charge steam line 146, the water charge tank 150 and the water charge line 156, and then flows into the process heater tube 82. The water charge steam line orifice plate 144 is not used to measure velocity steam flow rate, but creates a restriction to limit the amount of velocity steam flow rate through this alternative pathway.

Referring to FIG. 2, once it is decided, either automatically or manually, to initiate the on-line cleaning, the water charge solenoid valve 158 closes and the boiler feed water solenoid valve 164 opens, thus allowing the higher pressure boiler feed water to pass through the boiler feed water check valve 166 and the boiler feed water tee 154 and enter the water charge tank 150. The boiler feed water is operating at approximately 600 psig, preferably in the range of about 400 psig to about 600 psig. Ideally, the boiler feed water pressure should be preferably about 150 psig higher than the velocity steam pressure. While the water charge tank 150 is being filled with boiler feed water, the velocity steam is still flowing from the steam supply header 20 to the process heater tube 82 via only the steam line 22. The steam line control valve 26 remains in the last position it was in, just before the on-line cleaning was initiated. The steam line control valve 26 remains in this position until after all the short-cycles, which will be explained below, are completed; at which time the control panel (not shown) will resume controlling the steam line control valve 26. Also, the velocity steam which is trapped in the water charge tank 150 begins to be compressed and is prevented from flowing back into the steam line 22 because of the two water charge steam line check valves 140, 142. The 600 psig boiler feed water continues to fill the water charge tank 150 until the trapped 450 psig velocity steam pressure reaches equilibrium with the higher 600 psig boiler feed water pressure, which will be approximately at the 600 psig boiler feed water pressure. The pressure indicator transmitter 152 is located at the top portion of the water charge tank 150, the portion that remains in the vapor space after the velocity steam pressure and the boiler feed water pressure reach equilibrium. Once the pressure in the water charge tank 150 reaches equilibrium, the control panel (not shown) sends a signal to the boiler feed water solenoid valve 164 to close and a signal to the water charge solenoid valve 158 to open.

Continuing to refer to FIG. 2, once the boiler feed water solenoid valve 164 closes and the water charge solenoid valve 158 opens, the 600 psig high pressure velocity steam and boiler feed water, now called a water charge, exit the water charge tank 150 and enter the process heater tube 82 via the water charge line 156, thus flowing from high pressure to low pressure. The process fluid within the process heater tube is operating at a lower pressure and at a higher temperature. At this time, the velocity steam which was entering the process heater tube 82 via the steam line 22 stops because of the higher pressure water charge in the water charge line 156. The higher pressure water charge cannot enter the portion of the steam line 22 located upstream of the two steam line check valves 170, 172 and is forced into the process heater tube 82.

Once the water charge enters the process heater tube 82, the cleaning commences. The on-line cleaning occurs by two methods, a scrubbing action and a shocking action. The water charge enters the process heater tube 82, which is operating at a higher temperature, and begins to evaporate and boil intensively as it travels through the entire process heater tube 82. This intense boiling causes turbulence along the process heater tube's 82 inside wall, thereby performing the scrubbing action for on-line cleaning. This water charge's boiling temperature is at a much lower temperature than the process heater tube's 82 operating temperature, which creates a chilling effect along the inside wall of the process heater tube 82 as the water charge flows through it. The colder water charge causes the process heater tube 82 to contract. When the hot hydrocarbon process fluid follows the cold water charge, the process heater tube 82 is re-heated, thereby causing it to expand. This contraction and expansion of the process heater tube 82 creates the shocking action for on-line cleaning. Thus, there are two cleaning methods that are performed by the present invention—scrubbing and shocking.

Still referring to FIG. 2, once the water charge has been released from the water charge tank 150, the control panel (not shown) sends a signal to the boiler feed water solenoid valve 164 to open and a signal to the water charge solenoid valve 158 to close after an approximate 5 second delay after the water charge tank's 150 pressure returns to the 450 psig velocity steam pressure. This 5 second delay is to ensure that the entire water charge enters the process heater tube 82. It will be understood by one skilled in the art that, although the preferred embodiment allows a 5 second delay after the water charge tank's 150 pressure returns back to the velocity steam pressure, the time delay may be shorter or longer, depending upon the system, without departing from the scope and spirit of the present invention. At this time, the water charge tank 150 is recharged with water charge and when the water charge tank's 150 pressure is back up to the 600 psig boiler feed water pressure, the control panel (not shown) cycles the water charge solenoid valve 158 and the boiler feed water solenoid valve 164 again to release the water charge into the process heater tube 82.

Each time it is decided, either automatically or manually, to initiate the on-line cleaning, it is called a long-cycle. In the preferred embodiment, the on-line cleaning system is to have one long-cycle per hour. Each time a water charge is sent to the process heater tube 82, it is called a short-cycle. A short-cycle, with the time delay, takes approximately 15 seconds to perform according to the preferred embodiment. In the preferred embodiment, the on-line cleaning system is to have 8 short-cycles performed, one immediately after another, per long-cycle. The preferred embodiment has these long-cycles and short cycles programmed into the control panel (not shown). It will be apparent to one skilled in the art that, although the preferred embodiment has one long-cycle per hour and 8 short-cycles performed, one immediately after another, per long-cycle, the number of long-cycles and short cycles may vary per hour without departing from the scope and spirit of the present invention. Also, it will be understood by one skilled in the art that the short-cycle does not necessarily have to be performed immediately one after the other. It will also be understood by one skilled in the art that although the preferred embodiment has the long-cycles and short-cycles computer programmed, these cycles can be performed manually without departing from the scope and spirit of the present invention. The short-cycles will be dictated by not upsetting the downstream equipment, such as the coke drums and the combination tower in a delayed coker heater application. The long-cycles will be dictated by the crude quality and its fouling rate and what the downstream equipment is capable of handling without upsetting the system.

Figure 3:
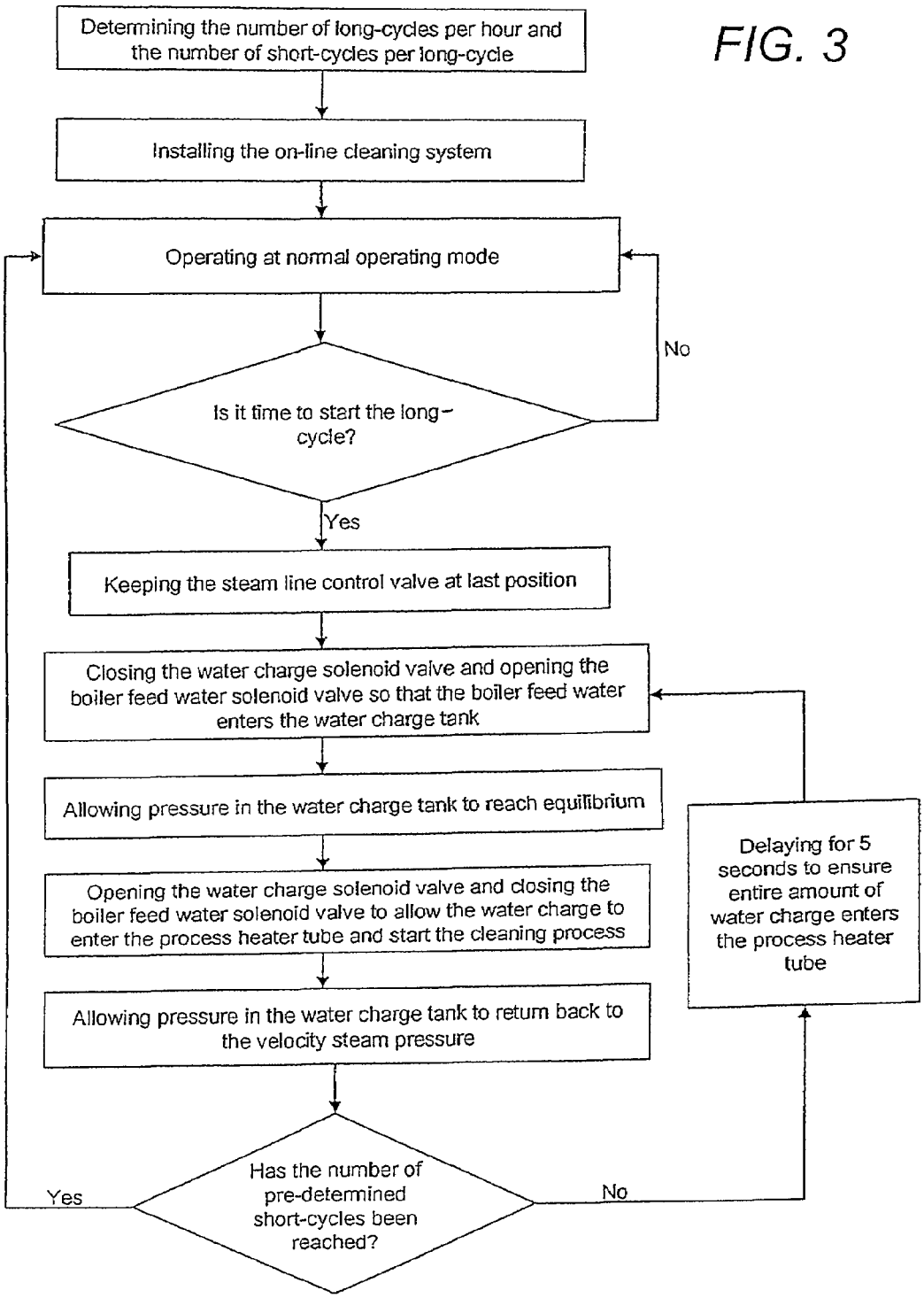
FIG. 3 illustrates a method for using the on-line cleaning system for black oil heaters and delayed coker heaters according to one embodiment of the present invention.

FIG. 3 illustrates a method for using the on-line cleaning system for black oil heaters and delayed coker heaters according to one embodiment of the present invention. The first step is determining the number of long-cycles per hour and the number of short-cycles per long-cycle and installing the water charge tank 150 (FIG. 2). The system is then allowed to operate at normal operating mode where the water charge solenoid valve 158 (FIG. 2) is in an open position and the boiler feed water solenoid valve 164 (FIG. 2) is in a close position. When it is time to commence the long-cycle, the steam line control valve 26 (FIG. 2) is kept at its last position and the water charge solenoid valve 158 (FIG. 2) is closed and the boiler feed water solenoid valve 164 (FIG. 2) is opened. This allows the boiler feed water to enter the water charge tank 150 (FIG. 2). The pressure in the water charge tank 150 (FIG. 2) is then allowed to reach equilibrium. Once an equilibrium pressure is reached, the water charge solenoid valve 158 (FIG. 2) is opened and the boiler feed water solenoid valve 164 (FIG. 2) is closed, thereby allowing the water charge to flow into the process heater tube 82 (FIG. 2). Once the water charge enters the process heater tube 82 (FIG. 2), cleaning is performed by a scrubbing action and a shocking action. The pressure in the water charge tank 150 (FIG. 2) eventually returns back to the velocity steam pressure. If the pre-determined number of short-cycles has not been reached, a 5 second delay occurs before performing another cycling of the valves, and hence another short cycle. If the pre-determined number of short-cycles has been reached, then the system returns to operating at normal operating mode until it is time to initiate another long-cycle. This on-line cleaning prevents fouling from occurring in the process heater tube 82 (FIG. 2).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. It is therefore, contemplated that the claims will cover any such modifications or embodiments that fall within the true scope of the invention.

What is claimed is:

1. A method for on-line cleaning and preventing tube fouling within a black oil heater comprising the steps of:

providing a black oil heater having a plurality of tubes;

providing a connector on the plurality of tubes;

providing a water charge line having a first end and a second end, wherein the second end is connected to the connector;

determining an amount of high pressure water to be injected into the plurality of tubes;

introducing the amount of high pressure water into the plurality of tubes via the water charge line while the black oil heater is continuously operating; and cleaning the plurality of tubes by allowing the amount of high pressure water to boil throughout the plurality of tubes.

2. The method of claim 1 wherein the black oil heater is a delayed coker heater.

3. The method of claim 1 wherein the high pressure water is boiler feed water.

4. The method of claim 1 wherein the high pressure water is introduced into the plurality of tubes automatically.

5. The method of claim 1 wherein the black oil heater is operating at a lower pressure and a higher temperature than the high pressure water.

6. The method of claim 1 wherein the cleaning occurs by contraction and expansion of the plurality of tubes and by turbulence created from the boiling of the high pressure water.

7. The method of claim 1 further providing an on/off valve on the water charge line.

8. The method of claim 1 further providing a container for holding the amount of high pressure water for supply to the plurality of tubes, wherein the container is connected to the first end of the water charge line.

9. The method of claim 1 wherein the high pressure water is introduced into the tubes in a long-cycle and a series of short cycles.

10. The system of claim 9 wherein the flow measuring device is an orifice plate.

11. The method of claim 9 wherein the short-cycle is eight times per the long-cycle.

12. A method for on-line cleaning and preventing tube fouling within a black oil heater comprising the steps of:

determining a predetermined amount of high pressure water to be injected into a plurality of tubes located within a black oil heater during the on-line cleaning mode;

determining a long-cycle, having a first rate, and a short-cycle, having a second rate, for the on-line cleaning mode;

providing a connector on the plurality of tubes;

providing a steam line for providing steam to the connector during normal operations, wherein the steam line comprises a flow measuring device and a control valve located upstream to a first steam line tee and at least one steam line check valve located between the first steam line tee and a second steam line tee;

providing a container designed to hold the predetermined amount of high pressure water;

providing a water charge steam line connecting the first steam line tee to the container, wherein the water charge steam line comprises at least one water charge steam line check valve and a flow restricting device;

providing a water charge line connecting the container to the second steam line tee, wherein the water charge line comprises a high pressure water tee and a first on/off valve, wherein the first on/off valve is in the open position during normal operations;

providing a high pressure water line connecting a high pressure water supply header to the high pressure water tee, wherein the high pressure water line comprises a second on/off valve and at least one high pressure water check valve, wherein the second on/off valve is in a closed position during normal operations;

allowing steam to flow to the plurality of tubes during normal operations;

initiating the long-cycle of the on-line cleaning mode;

filling the container with high pressure water by closing the first on/off valve and opening the second on/off valve;

allowing the pressure in the container to reach an equilibrium pressure;

transferring the high pressure water in the container to the plurality of tubes by opening the first on/off valve and closing the second on/off valve;

cleaning the plurality of tubes by allowing the predetermined amount of high pressure water to boil throughout the plurality of tubes;

allowing the pressure in the container to return back to the normal operating pressure;

repeating the short-cycles by cycling the first on/off valve and the second on/off valve until the short-cycles are completed; and returning to normal operating mode until the long-cycle initiates again.

13. The method of claim 12 wherein the black oil heater is a delayed coker heater.

14. The method of claim 12 wherein the high pressure water is boiler feed water.

15. The method of claim 12 wherein the high pressure water is introduced into the plurality of tubes automatically.

16. The method of claim 12 wherein the black oil heater is operating at a lower pressure and a higher temperature than the high pressure water.

17. The method of claim 12 wherein the cleaning occurs by contraction and expansion of the plurality of tubes and by turbulence created from the boiling of the high pressure water.

18. The method of claim 12 wherein the container is made of carbon steel.

19. The method of claim 12 wherein the container is made of stainless steel.

20. The method of claim 12 wherein the container is made of 1¼ chrome.

21. The method of claim 12 wherein the container is made of 2¼ chrome.

22. The method of claim 12 wherein the container is made of 5 chrome.

23. The method of claim 12 wherein the container is made of 9 chrome.

24. The method of claim 12 wherein the first rate is once per hour.

25. The method of claim 12 wherein the second rate is eight times per the long-cycle.

26. The method of claim 12 wherein the flow measuring device is an orifice plate.

27. The method of claim 12 wherein the flow restricting device is an orifice plate.

28. The method of claim 12 wherein the first on/off valve is a solenoid valve.

29. The method of claim 12 wherein the second on/off valve is a solenoid valve.

30. The method of claim 12 wherein the steam flows primarily through the steam line and secondarily through the water charge line via the container during normal operations.

31. The method of claim 12 wherein the equilibrium pressure is about the pressure of the high pressure water.

32. An on-line cleaning system for preventing tube fouling within a black oil heater comprising:

a steam line connecting a steam supply header to a plurality of tubes located within the black oil heater via a connector, wherein the steam line comprises a flow measuring device and a control valve located upstream to a first steam line tee and at least one steam line check valve located between the first steam line tee and a second steam line tee;

a container designed to hold an amount of high pressure water to be supplied to the plurality of tubes during on-line cleaning;

a water charge steam line connecting the first steam line tee to the container, wherein the water charge steam line comprises at least one water charge steam line check valve and a flow restricting device;

a water charge line connecting the container to the second steam line tee, wherein the water charge line comprises a high pressure water tee and a first on/off valve; and a high pressure water line connecting a high pressure water supply header to the high pressure water tee, wherein the high pressure water line comprises a second on/off valve and at least one high pressure water check valve.

33. The system of claim 32 wherein the flow measuring device is an orifice plate.

34. The system of claim 32 wherein the high pressure water is boiler feed water.

35. The system of claim 32 wherein the flow restricting device is an orifice plate.

36. The system of claim 32 wherein the first on/off valve is a solenoid valve.

37. The system of claim 32 wherein the second on/off valve is a solenoid valve.

38. The system of claim 32 wherein the container is sized having a height and a diameter with a 2:1 ratio.

39. The system of claim 32 wherein the container is made of carbon steel.

40. The system of claim 32 wherein the container is made of stainless steel.

41. The system of claim 32 wherein the container is made of 1¼ chrome.

42. The system of claim 32 wherein the container is made of 2¼ chrome.

43. The system of claim 32 wherein the container is made of 5 chrome.

44. The system of claim 32 wherein the container is made of 9 chrome.

45. The system of claim 32 wherein the pressure of the steam supply header is operating in the range of about 250 psig to about 450 psig.

46. The system of claim 45 wherein the temperature of the steam supply header is operating at about 50° F. superheat.

47. The system of claim 32 wherein the pressure of the high pressure water supply header is operating in the range of about 400 psig to about 600 psig.

48. The system of claim 32 wherein the operating pressure of the high pressure water supply header is about 150 psig greater than the operating pressure of the steam supply header.

49. The system of claim 32 wherein the flow restricting device is located downstream of the at least one water charge steam line check valve.

50. The system of claim 32 wherein the first on/off valve is located downstream of the high pressure water tee.

51. The system of claim 32 wherein the at least one high pressure water check valve is located downstream of the second on/off valve.

52. The system of claim 32 wherein the first on/off valve is in an open position and the second on/off valve is in a closed position during normal operations.

53. The system of claim 32 wherein the container further comprises a pressure indicator transmitter.

54. The system of claim 53 wherein the first on/off valve and the second on/off valve are controlled automatically via a computer program.

55. The system of claim 32 wherein the first on/off valve and the second on/off valve are controlled manually.

* * * * *